US010458439B2

(12) United States Patent
Zapico et al.

(10) Patent No.: US 10,458,439 B2
(45) Date of Patent: Oct. 29, 2019

(54) METERING FLUID TO FLUID ACTUATORS

(71) Applicant: Schlumberger Technology Corporation, Sugar Land, TX (US)

(72) Inventors: James Zapico, Houston, TX (US); Joe Rodney Berry, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 297 days.

(21) Appl. No.: 15/364,692

(22) Filed: Nov. 30, 2016

(65) Prior Publication Data

US 2018/0149174 A1 May 31, 2018

(51) Int. Cl.

| | |
|---|---|
| ***E21B 15/04*** | (2006.01) |
| ***F15B 11/16*** | (2006.01) |
| ***F15B 13/02*** | (2006.01) |
| ***F15B 13/06*** | (2006.01) |
| ***F15B 21/00*** | (2006.01) |
| ***F15B 21/02*** | (2006.01) |
| ***E21B 15/00*** | (2006.01) |

(52) U.S. Cl.

CPC ..... *F15B 11/16* (2013.01); *E21B 15/00* (2013.01); *F15B 13/022* (2013.01); *F15B 13/06* (2013.01); *F15B 21/001* (2013.01); *F15B 21/02* (2013.01); *F15B 2211/30* (2013.01); *F15B 2211/455* (2013.01); *F15B 2211/7058* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,855,794 A * | 12/1974 | Meyer | F15B 11/22 60/546 |
| 5,025,625 A * | 6/1991 | Morikawa | E02F 3/42 137/596 |
| 5,101,907 A * | 4/1992 | Schultz | E21B 23/04 166/319 |
| 2018/0149175 A1* | 5/2018 | Zapico | F15B 13/0401 |

* cited by examiner

*Primary Examiner* — Taras P Bemko
*Assistant Examiner* — Ronald R Runyan
(74) *Attorney, Agent, or Firm* — Rachel E. Greene

(57) ABSTRACT

Apparatus and methods for metering fluid to a fluid actuator. An example apparatus may include a hydraulic actuator, a fluid chamber, and a hydraulic directional control valve. The fluid chamber may include a piston slidably movable between first and second ends of the fluid chamber and dividing the chamber into first and second chamber portions. The hydraulic directional control valve may direct a fluid from a fluid source into the first chamber portion to cause a volume of fluid to be discharged out of the second chamber portion into the hydraulic actuator to actuate the hydraulic actuator by a distance corresponding to the volume of fluid received by the hydraulic actuator.

4 Claims, 5 Drawing Sheets

METERING FLUID TO FLUID ACTUATORS

BACKGROUND OF THE DISCLOSURE

Wells are generally drilled into the ground or seabed to recover natural deposits of oil and gas, as well as other natural resources trapped in geological formations in the Earth's crust. Such wells are drilled using a drill bit attached to a lower end of a drill string or other drill piping. Drilling fluid ("mud") is pumped from the wellsite surface down through the drill piping to the drill bit. The drilling fluid lubricates and cools the bit, and may additionally carry drill cuttings from the wellbore back to the surface from which the wellbore extends.

A typical drilling rig includes various lifting, rotating, and moving equipment utilized during rig assembly and drilling operations. Fluid actuators, such as hydraulic cylinders and rotary actuators, may power or actuate the moving equipment. Although fluid actuators may provide sufficient speeds and forces, precise movement and positioning of fluid actuators, especially fluid actuators comprising large bores or fluid volumes, is difficult to achieve. For example, controlling large capacity fluid actuators to perform small or short movements may be difficult as fluid directional control valves typically associated with large capacity fluid actuators are not able to meter hydraulic fluid at low flow rates. Inability to perform precise and/or small movements by the fluid actuators may result in difficulty or inability to align portions of the drilling rig and drilling tools during rig assembly and drilling operations, causing operational delays. For example, aligning a mast and substructure raising cylinder (MSRC) with a corresponding pin connector of a mast and substructure of a drill rig may be a problematic and time consuming task, as small movements of each MSRC manipulating cylinder translate to relatively large movements of the MSRC. Also, manual hydraulic directional control valves typically utilized to operate the MSRC manipulating cylinders to adjust the position of the MSRC do not have the ability to cause fine movements of the MSRC manipulating cylinders and, thus, do not provide the ability to make fine adjustments to the position of the MSRC.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a hydraulic actuator, a fluid chamber, and a hydraulic directional control valve. The fluid chamber includes a piston slidably movable between first and second ends of the fluid chamber and dividing the chamber into first and second chamber portions. The hydraulic directional control valve is operable to direct a fluid from a fluid source into the first chamber portion to cause a volume of fluid to be discharged out of the second chamber portion into the hydraulic actuator to actuate the hydraulic actuator by a distance corresponding to the volume of fluid received by the hydraulic actuator.

The present disclosure also introduces an apparatus including a hydraulic actuator, a fluid chamber, and a hydraulic directional control valve. The fluid chamber includes a piston and first and second ports. The piston is slidably movable between first and second ends of the fluid chamber. The first port extends into the fluid chamber on one side of the piston. The second port extends into the fluid chamber on an opposing side of the piston. The second port is fluidly connected with the hydraulic actuator. The hydraulic directional control valve includes first, second, third, and fourth ports. The first port of the hydraulic directional control valve is fluidly connected with a fluid source. The second port of the hydraulic directional control valve is fluidly connected with a tank. The third port of the hydraulic directional control valve is fluidly connected with the first port of the fluid chamber. The fourth port of the hydraulic directional control valve is fluidly connected with the second port of the fluid chamber. The hydraulic directional control valve is operable to direct fluid from the fluid source into the first port of the fluid chamber to cause the piston to move from the first end to the second end and discharge a volume of fluid out of the second port of the fluid chamber into the hydraulic actuator to move the hydraulic actuator by an incremental distance corresponding to the volume of fluid received by the hydraulic actuator.

The present disclosure also introduces a method including directing a fluid from a fluid source into a first portion of a chamber until a piston moves from a first end of the chamber to a second end of the chamber, thereby introducing a volume of fluid into the first portion of the chamber and discharging the fluid from the second portion of the chamber. The method also includes directing the fluid from the fluid source into the second portion of the chamber until the piston moves from the second end of the chamber to the first end of the chamber, thereby introducing the fluid into the second portion of the chamber and discharging the volume of fluid out of the first portion of the chamber into a hydraulic actuator to actuate the hydraulic actuator by an incremental distance.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
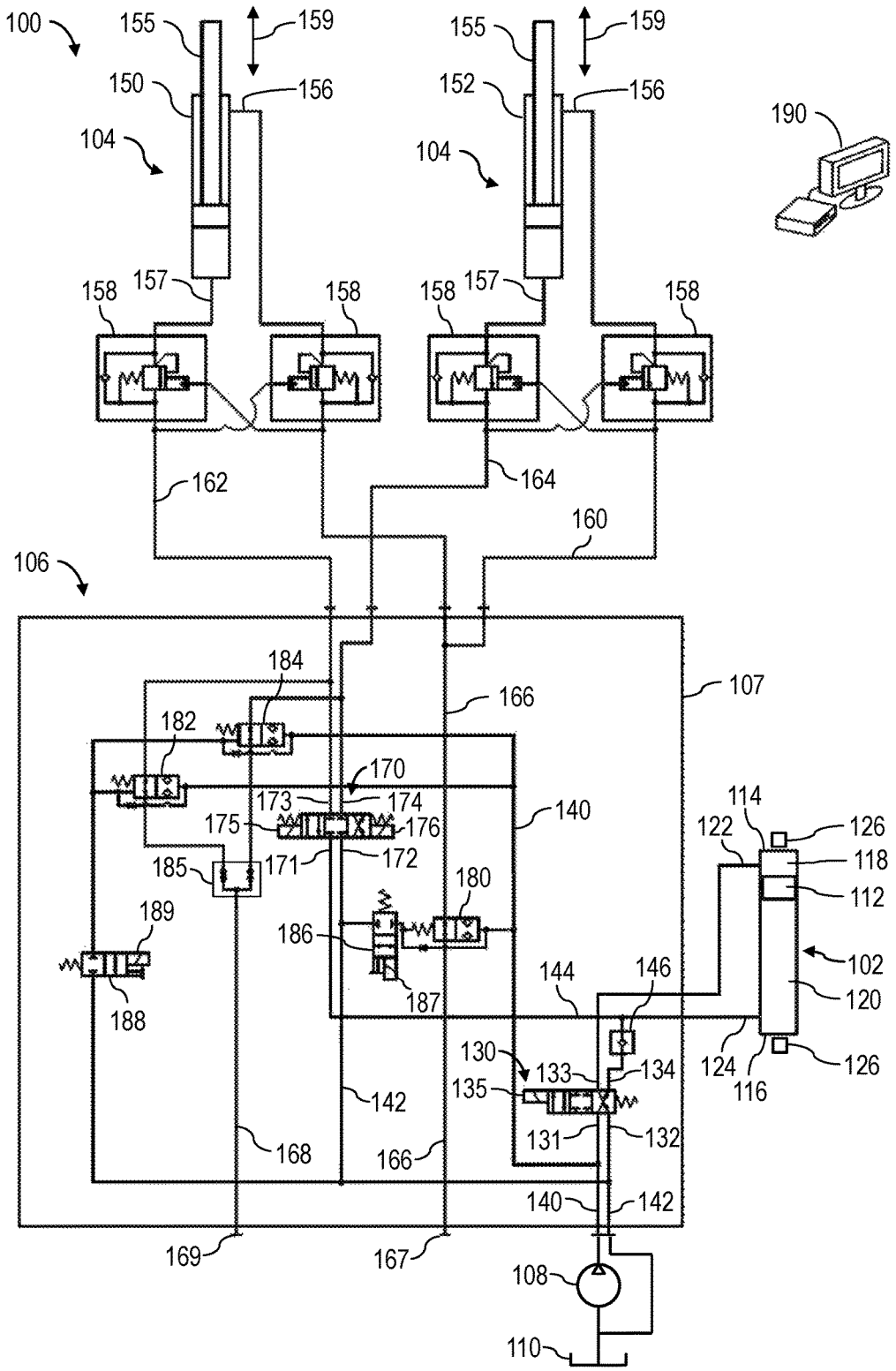
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. It should also be understood that the terms "first," "second," "third," etc., are arbitrarily assigned, are merely intended to differentiate between two or more parts, fluids, etc., and do not indicate a particular orientation or sequence.

The present disclosure is directed to an apparatus and methods utilizing one or more fluid chambers, having a known or predetermined volume, to meter a fluid that is directed to a fluid actuator to precisely control the fluid actuator. The chamber may comprise a piston slidably disposed therein and movable between opposing ends of the chamber. The piston may divide the chamber into opposing volumes or portions. The chamber may further comprise a fluid port on one side of the piston and fluidly connected with one chamber portion. The fluid port may be operable to receive and discharge the fluid into and out of the chamber portion. The chamber may further comprise another fluid port on an opposing side of the piston and fluidly connected with the other chamber portion. Such fluid port may be operable to receive and discharge the fluid into and out of the other chamber portion. During operations, the fluid may be received by and discharged from one or both of the chamber portions via the corresponding ports and directed to the fluid actuator. Since the volume of each chamber portion is known, a volume of fluid that is discharged from the chamber and received by the fluid actuator is also known. Accordingly, movement or position of the fluid actuator is known based on displacement of the actuator or other volume-to-movement characteristics of the fluid actuator.

Example implementations of apparatus and methods described herein relate generally to utilizing one or more chambers as part of a hydraulic system to meter pressurized hydraulic fluid to control motion of one or more hydraulic actuators at an oil and gas wellsite. An example hydraulic system within the scope of the present disclosure may be operable to direct the hydraulic fluid from a fluid source into the chamber via one of the chamber ports to cause the piston to move between the opposing ends of the chamber to cause the known or predetermined volume of hydraulic fluid to be discharged from the chamber via the other port. The known or predetermined volume of hydraulic fluid may be substantially equal to the volume of the fluid chamber less a volume of the piston. The hydraulic system may be further operable to direct the known or predetermined volume of hydraulic fluid into the hydraulic actuator to actuate the hydraulic actuator by an incremental step or distance corresponding to or associated with the known or predetermined volume of hydraulic fluid received by the hydraulic actuator.

FIG. 1 is a schematic view of at least a portion of an example implementation of a hydraulic system 100 utilizing a fluid chamber 102 for metering hydraulic fluid to precisely control one or more hydraulic linear actuators 104 according to one or more aspects of the present disclosure. Volume of the fluid chamber 102 may be predetermined or otherwise known. The hydraulic system 100 may further comprise a hydraulic control system 106 operable to direct or otherwise control flow of the hydraulic fluid from a pump or another source 108 of a pressurized hydraulic fluid into the chamber 102, into one or more of the hydraulic linear actuators 104, and into a hydraulic fluid container or tank 110.

The chamber 102 may comprise a piston 112 slidably disposed within the chamber 102 and movable between opposing ends 114, 116 of the chamber 102. The piston 112 may divide the chamber 102 into opposing chamber volumes or portions 118, 120. The chamber 102 may further comprise a fluid port 122 on one side of the piston 102 and fluidly connected with the chamber portion 118. The chamber 102 may also comprise another fluid port 124 on an opposing side of the piston 112 and fluidly connected with the other chamber portion 120. During operations, the hydraulic fluid may be received by one of the chamber portions 118, 120 via the corresponding port 122, 124, discharged from the other of the chamber portions 118, 120 via the corresponding port 122, 124, and directed to one or more of the actuators 104. Maximum volume of the chamber portion 118 may be substantially equal to the volume of the chamber 102 less the volume of the piston 112 when the piston 112 is positioned against the end 116. Maximum volume of the chamber portion 120 may be substantially equal to the volume of the chamber 102 less the volume of the piston 112 when the piston 112 is positioned against the end 118. Accordingly, the volumes of hydraulic fluid that may be received by the chamber 102 as the piston 112 moves or strokes between the chamber ends 114, 116, may be substantially equal to the maximum volumes of the chamber portions 118, 120. Such volumes may be referred to hereinafter as "stroke volumes." The chamber 102 and the piston 112 may be configured such that the stroke volumes discharged from each of the chamber portions 118, 120 may be substantially equal. The fluid chamber 102 may be implemented as a rodless hydraulic cylinder, which may comprise a 2.54 centimeter (1.00 inch) bore and a 2.54 centimeter (1.00 inch) piston stroke. Accordingly, an example stroke volume of the chamber 102 may be about 12.86 cubic centimeters (0.785 cubic inch).

The chamber 102 may include or otherwise have associated one or more sensors 126 operable to generate a signal or information indicative of position and/or velocity of the piston 112 with respect to the chamber 102 and/or ends 114, 116 of the chamber 102, such as may be utilized to monitor the position and/or velocity of the piston 112. The sensors 126 may be disposed in association with the chamber 102 in a manner permitting sensing of the position and/or velocity of the piston 112. For example, the sensors 126 may be disposed at each end 114, 116 of the chamber 102 to monitor when the piston 112 reaches each end 114, 116 of the chamber 102. One or more of the sensors 126 may also extend along the length of the chamber 102 to monitor the position and/or velocity of the piston 112 along the entire length of the chamber 102. The sensors 126 may be or comprise linear encoders, linear potentiometers, capacitive sensors, inductive sensors, magnetic sensors, linear variabledifferential transformers (LVDT), proximity sensors, Hall effect sensors, and/or reed switches, among other examples.

The hydraulic control system 106 may comprise a hydraulic directional control valve 130 operable to selectively fluidly connect the fluid source 108 with one of the chamber portions 118, 120. The valve 130 may comprise an inlet port 131 fluidly connected with the fluid source 108 via a pressure line 140, an outlet port 132 fluidly connected with the tank 110 via a drain line 142, a working port 133 fluidly connected with the chamber port 122, and another working port 134 fluidly connected with the chamber port 124. The valve 130 may be shifted or otherwise operated by a valve actuator 135, such as a solenoid, to selectively direct the hydraulic fluid from the fluid source 108 into one of the chamber portions 118, 120 via one of the working ports 133, 134 and direct the hydraulic fluid from the chamber portion 118 to the tank 110. For example, in its idle position, the valve 130 may direct the hydraulic fluid from the fluid source 108 into the chamber portion 120 and direct the hydraulic fluid discharged from the chamber portion 118 into the tank 110. However, activating the actuator 135 may cause the valve 130 to direct the fluid into the chamber portion 118 causing the hydraulic fluid to be discharged from the chamber portion 120. However, a check valve 146 positioned at the working port 134 may prevent the hydraulic fluid from returning through the valve 130, causing the hydraulic fluid to flow to the hydraulic linear actuators 104 via a metered fluid supply line 144 fluidly connected with the chamber portion 120.

The hydraulic linear actuators 104 may be or comprise hydraulic cylinders 150, 152, each comprising a corresponding slidable piston-and-rod assembly 155 and fluid ports 156, 157 operable to receive the hydraulic fluid to cause each piston-and-rod assembly 155 to extend and/or retract, as indicated by arrows 159. The ports 157 may receive the hydraulic fluid from the chamber 102 to cause the cylinders 150, 152 to extend, while the ports 156 may be fluidly connected via a cylinder conduit 160 to permit flow of the hydraulic fluid between the cylinders 150, 152. Each cylinder 150, 152 may comprise a predetermined or known bore size, which relates the volume of the received hydraulic fluid to the resulting movement of each cylinder 150, 152. Accordingly, position and/or movement of each cylinder 150, 152 may be determined based on the cylinder bore size and the volume of the hydraulic fluid received by each cylinder 150, 152.

Counterbalance or brake valves 158 may be fluidly connected at one or both of the ports 156, 157 of the cylinders 150, 152. Each counterbalance valve 158 may permit fluid flow out of a corresponding port 157, 158 when a predetermined pressure is detected at the other port 157, 158, and may prevent fluid flow when the predetermined pressure is not detected at the other port 157, 158. Accordingly, the counterbalance valves 158 may be operable to control motion of a load actuated by the cylinders 150, 152 based on application of fluid pressure at the ports 157, 158. The counterbalance valves 158 may also prevent the cylinders 150, 152 from running away or drifting due to pressure differentials caused by heavy loads or pressure losses caused by hydraulic line failure or hydraulic fluid leakage.

The hydraulic control system 106 may further comprise a hydraulic directional control valve 170 fluidly connecting the cylinders 150, 152 with the chamber 102 and the tank 110. The valve 170 may comprise an inlet port 171 fluidly connected with the chamber portion 120 via the metered fluid supply line 144, an outlet port 172 fluidly connected with the tank 110 via the drain line 142, a working port 173 fluidly connected with the port 157 of the cylinder 150 via cylinder line 162, and another working port 174 fluidly connected with the port 157 of the cylinder 152 via cylinder line 164. The valve 170 may be shifted or otherwise operated by one of opposing actuators 175, 176, such as solenoids, to direct the hydraulic fluid from the metered fluid supply line 144 into a selected cylinder 150, 152 via the corresponding cylinder line 162, 164 to extend the piston-and-rod assembly 155 of the selected cylinder 150, 152 by a predetermined distance. In its idle state, the valve 170 may fluidly isolate the ports 173, 174 from ports 171, 172, such as to maintain the cylinders 150, 152 in position.

The valve 170 may be utilized to actuate both cylinders 150, 152, but in opposite directions. As the ports 156 of the cylinders 150, 152 are fluidly connected via the cylinder line 160, the hydraulic fluid discharged from an extending one of the cylinders 150, 152 may be directed into the other cylinder 150, 152 via the cylinder line 160 to retract the corresponding piston-and-rod assembly 155 by substantially the same predetermined distance. The fluid discharged by the retracting one of the cylinders 150, 152 may be communicated back to the valve 170 via the corresponding one of the cylinder lines 162, 164 and directed into the drain line 142 for return to the tank 110.

The valve 170 may also be utilized to actuate one of the cylinders 150, 152, independently of the other cylinder 150, 152. Instead of directing the hydraulic fluid discharged from one cylinder 150, 152 to the other cylinder 150, 152 via the cylinder line 160, the hydraulic fluid discharged from the cylinder 150, 152 may be selectively directed out of the hydraulic control system 106 via a cylinder line 166 extending between the cylinder line 160 and a port 167. A fluid shut-off valve 180 may be fluidly connected along the cylinder line 166 to selectively permit the hydraulic fluid to flow from the cylinder line 160 to the port 167 via the cylinder line 166. The port 167 may be fluidly connected with the tank 110 or another hydraulic fluid destination. The valve 180 may be a normally open-flow valve permitting flow through the cylinder line 166 in its idle state and selectively operated to prevent fluid flow through the cylinder line 166. For example, the valve 180 may be a pressure-operated valve fluidly connected with the pressure line 140. When fluid pressure on opposing sides of the valve 180 is equal, the valve 180 may remain in the open-flow position and when the fluid pressure on the opposing sides of the valve 180 is not equal, the valve 180 may be shifted to the closed-flow position.

The valve 180 may be operated by a fluid shut-off valve 186 fluidly connected between the valve 180 and the drain line 142. The valve 186 may be a normally closed-flow valve preventing fluid communication between the valve 180 and the drain line 166 in its idle state and selectively operated to fluidly connect the valve 180 with the drain line 166 to depressurize one side of the valve 180 to shift the valve 180 to the closed-flow position. Accordingly, in its idle state, the valve 186 may cause the valve 180 to be maintained in its open-flow position to permit the hydraulic fluid to flow out of the cylinder line 160 to permit the valve 170 to actuate one of the cylinders 150, 152, independently of the other cylinder 150, 152. However, in its actuated state, the valve 186 may cause the valve 180 to be shift to its closed-flow position to prevent the hydraulic fluid from flowing out of the cylinder line 160 to permit the valve 130 to actuate both cylinders 150, 152 in opposite directions. The valve 186 may be shifted or otherwise operated by an actuator 187, such as a solenoid and/or a manual operator, to selectively operate the valve 186.

The hydraulic system 100 may be set to a metering mode, in which the hydraulic fluid discharged by the fluid source 108 is metered via the chamber 102 and controlled by the valves 130, 170, and a manual mode, in which the hydraulic cylinders 150, 152 are controlled independently of the chamber 102 and the valves 130, 170. During the metering mode, the hydraulic control system 106 may operate the cylinders 150, 152 via the chamber 102 and the valves 130, 170, as described above. However, during the manual mode, the cylinders 150, 152 may be controlled by communicating the hydraulic fluid into and out of the cylinders 150, 152 via the port 167 and cylinder lines 160, 166 to retract the cylinders 150, 152 and via a port 169 and cylinder lines 162, 164, 168 to extend the cylinders 150, 152.

The hydraulic control system 106 may further comprise fluid shut-off valves 182, 184 fluidly connected between the cylinder line 168 and the cylinder lines 162, 164, respectively, to selectively permit fluid communication between port 169 and the cylinder ports 157. A flow divider/combiner valve 185 may split the cylinder line 168 into two separate fluid lines, each fluidly connected with one of the cylinder lines 162, 164, such as may permit simultaneous extension of both cylinders 150, 152. The port 169 may be fluidly connected with the fluid source 108 or another hydraulic fluid source selectively operable to supply pressurized hydraulic fluid. Each valve 182, 184 may be a normally open-flow valve permitting flow through the cylinder line 168 in its idle state and selectively operated to prevent fluid flow through the cylinder line 168. The valves 182, 184 may be pressure-operated valves fluidly connected with the pressure line 140. When fluid pressures on opposing sides of the valves 182, 184 are equal, the valves 182, 184 may remain in the open-flow position and when the fluid pressures on the opposing sides of the valves 182, 184 are not equal, the valves 182, 184 may be shifted to the closed-flow position.

The valves 182, 184 may be operated by a fluid shut-off valve 188 fluidly connected between the valves 182, 184 and the drain line 142. The valve 188 may be a normally closed-flow valve preventing fluid communication between the valves 182, 184 and the drain line 142 in its idle state and selectively operated to fluidly connect the valves 182, 184 with the drain line 142 to depressurize one side of the valves 182, 184 to shift the valves 182, 184 to the closed-flow position. Accordingly, in its idle state, the valve 188 causes the valves 182, 184 to be maintained in their open-flow position to permit the hydraulic fluid to flow between the cylinder ports 157 and the port 169. However, in its actuated state, the valve 188 may cause the valves 182, 184 to shift to their closed-flow position to prevent the hydraulic fluid from flowing between the cylinder ports 157 and the port 169. The valve 188 may be shifted or otherwise operated by an actuator 189, such as a solenoid and/or a manual operator, to selectively operate the valves 182, 184. The valve 188 may be substantially similar to the valve 186 described above.

Accordingly, to operate the hydraulic system 100 in the manual mode, both of the valves 186, 188 may be maintained in their idle positions to permit hydraulic fluid communication between the cylinders 150, 152 and the ports 167, 169 via the cylinder lines 162, 164, 160, 166, 168. To operate the hydraulic system 100 in the manual mode, the valve 170 may also be maintained in the idle position to fluidly isolate the cylinder lines 162, 164 from the pressure and drain lines 140, 142. However, to operate the hydraulic system 100 in the metering mode, the valve 188 may be actuated to shift the valves 182, 184 to their closed-flow positions to prevent hydraulic fluid communication between the cylinders 150, 152 and the port 169 via the cylinder lines 162, 164, 168. Once the cylinders 150, 152 are isolated from the port 169, the valves 130, 170 may be operated to perform the metering operations.

The various components of the hydraulic control system 106 may be fluidly connected via one or more manifolds. For example, the hydraulic control system 106 may include a manifold 107 comprising at least a portion of the cylinder lines 166, 168, the pressure line 140, the drain line 142, and the metered fluid supply line 144, and having the valves 130, 170, 180, 182, 184, 185, 186, 188 mounted thereto.

A controller 190 may be operable to monitor and control one or more operations of the hydraulic system 100. The controller 190 may be in communication with the fluid source 108, the valves 130, 170, 186, 188 and the sensors 126 to adjust or otherwise control flow of the hydraulic fluid to control the movement and position of the hydraulic cylinders 150, 152. In the manual mode, the controller 190 may be operable to maintain the valves 170, 186, 188 in idle position to permit the hydraulic fluid to be directed into and out of the hydraulic cylinders 150, 152 via the ports 167, 169. In the metering mode, the controller 190 may actuate the valve 188 to actuate the valves 182, 184 to the closed position to prevent communication of the hydraulic fluid via the port 169.

The position sensors 126 may be in communication with the controller 190 to permit the controller 190 to receive feedback signals generated by the position sensors 126 and, thus, confirm that the piston 112 has moved between the opposing chamber ends 114, 116 to discharge the known stroke volume of the hydraulic fluid before the valve 130 is shifted to move the piston 112 in the opposing direction. The position sensors 126 may also generate signals indicative of intermediate piston positions as the piston 112 moves between the opposing chamber ends 114, 116. Such signals may be utilized by the controller 190 to determine volumes of the hydraulic fluid, including volumes that may be less than the stroke volumes, being discharged from the chamber 102.

In the metering mode, the controller 190 may be operable to cause the valve 130 to direct the hydraulic fluid from the fluid source 108 into the chamber portion 120 until the piston 112 reaches the chamber end 114 to fill the chamber portion 120 with a stroke volume of hydraulic fluid and to discharge the hydraulic fluid from the chamber portion 118 into the tank 110. Thereafter, the controller 190 may be operable to cause the valve 130 to direct fluid from the fluid source 108 into the chamber portion 118 until the piston 112 reaches the chamber end 116 to cause the stroke volume of the hydraulic fluid to be discharged out of the chamber portion 120 toward the valve 170 via the metered fluid supply line 144. The position sensors 126 may be in communication with the controller 190 to permit the controller 190 to receive feedback signals generated by the position sensors 126 and, thus, confirm that the piston 112 has moved between the opposing chamber ends 114, 116 to discharge the stroke volume of the hydraulic fluid. The controller 190 may also maintain the valve 186 in the idle position and actuate the valve 170 to direct the discharged stroke volume of the hydraulic fluid to one of the hydraulic cylinders 150, 152 to extend the hydraulic cylinder 150, 152 by a distance corresponding to the stroke volume of the hydraulic fluid received by the hydraulic cylinder 150, 152. The distance or movement of the hydraulic cylinder 150, 152 may be know or determined based on the displacement of the hydraulic cylinder 150, 152 receiving the hydraulic fluid.

The controller 190 may be further operable to cause both cylinders 150, 152 to move in opposing directions. For example, the controller 190 may actuate the valve 186 to operate the valve 180 to the closed-flow position to prevent the hydraulic fluid discharged from the actuated cylinder 150, 152 from being discharged via the port 167. Accordingly, the hydraulic fluid being discharged via the cylinder ports 156 may be directed to the port 156 of the other cylinder 150, 152 via the cylinder conduit 160 to retract the other cylinder 150, 152 by the same distance.

The controller 190 may also control the number of times the valve 130 is shifted between the opposing flow positions to control the number of stroke volumes of the hydraulic fluid that are communicated to the valve 170 to control the position of the hydraulic cylinders 150, 152 and the load connected to the hydraulic cylinders 150, 152. For example, the controller 190 may be operable to store information related to a predetermined number of stroke volumes to be discharged from the chamber 102 or the number of piston strokes to be performed to achieve an intended or predetermined movement or position of the hydraulic cylinders 150, 152. The controller 190 may be further operable to record the number the strokes performed by the piston 112 based on the signals generated by the position sensors 126, and cause the valve 130 to stop directing the hydraulic fluid to the chamber 102 when the recorded number of strokes performed by the piston 112 is equal to the predetermined number of strokes.

Communication between the controller 190 and the various portions of the hydraulic system 100 may be via wired and/or wireless communication means. However, for clarity and ease of understanding, such communication means are not depicted in FIG. 1, as a person having ordinary skill in the art will appreciate that such communication means are within the scope of the present disclosure.

Figures 2, 3:
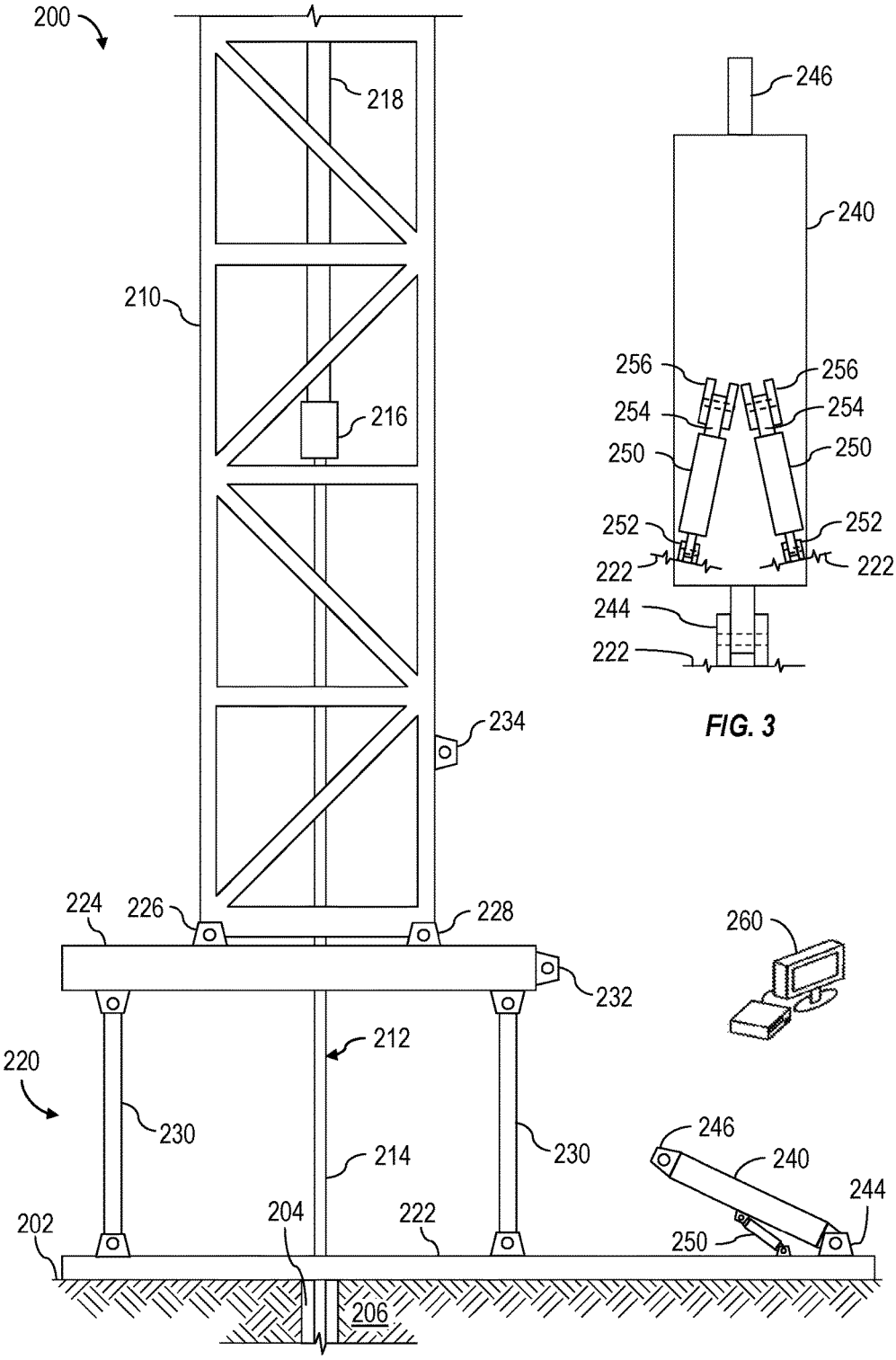
FIG. 2 is a schematic view of at least a portion of an example implementation of apparatus according to one or more aspects of the present disclosure.
FIG. 3 is a bottom view of a portion of the apparatus shown in FIG. 2 according to one or more aspects of the present disclosure.

FIG. 2 is a schematic view of at least a portion of an example wellsite system 200 according to one or more aspects of the present disclosure, representing an example environment in which the hydraulic system 100, shown in FIG. 1, may be implemented. The following description refers to FIGS. 1 and 2, collectively.

The wellsite system 200 may be a stationary or mobile drilling system positioned or assembled at a wellsite surface 202 and operable to form a wellbore 204 extending into a rock formation 206. The wellsite system 200 may comprise a bottom hole assembly (BHA) (not shown) suspended via a drill string 212 from a mast 210 erected or otherwise assembled in a vertical position above the wellsite surface 202. The drill string 212 may be or comprise a plurality of drill pipes 214 threadedly engaged to collectively form the drill string 212. The drill string 212 may be rotated by a top drive 216 suspended from the mast 210 and conveyed vertically by a drawworks (not shown) via a cable 218 to advance the wellbore 204.

Figure 4:
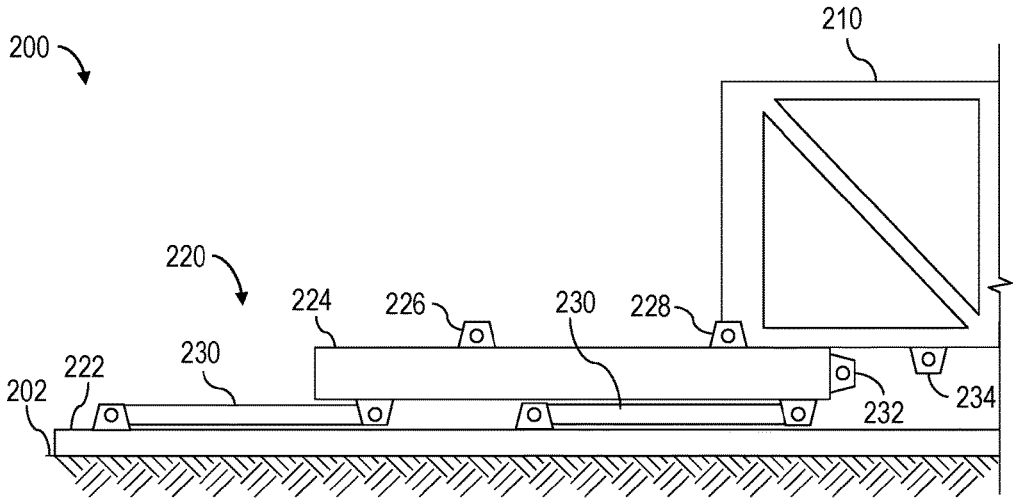
FIG. 4 is another view of the apparatus shown in FIG. 2 in a different stage of operation.

The mast 210 may be supported by a collapsible substructure 220 comprising a base 222 positioned on the wellsite surface 202 and a drill floor 224 located above the base 222. A plurality of shoe connectors 226, 228 may be operable to maintain the mast 210 connected with the drill base 224 in the vertical position. A plurality of legs 230 may be pivotally connected between the drill floor 224 and the base 222. One or more mast and substructure raising cylinders 240 may be pivotally connected with the base 222 and operable to raise the mast 210 into the vertical position above substructure 220 and to raise the substructure 220 from a transportable collapsed position to a deployed position above the base 222, as shown in FIG. 2. The one or more raising cylinders 240 may be further operable to lower the substructure 220 from the deployed position to the transportable collapsed position and to lower the mast 210 into the horizontal position, as shown in FIGS. 3 and 4. The one or more raising cylinders 240 may be temporarily coupled with the drill floor 224 and the mast 210 via corresponding connectors 232, 234, such as may permit the raising cylinders 240 to raise and lower the drill floor 224 and the mast 210. The connectors 232, 234 may be or comprise pin connectors, such as rod eye connectors, clevis connectors, or other connectors operable to facilitate a pivoting connection.

FIG. 3 is a bottom view of the raising cylinder 240 shown in FIG. 2 according to one or more aspects of the present disclosure. The following description refers to FIGS. 1-3, collectively.

The raising cylinder 240 may be a multi-stage telescoping cylinder operable to extend a plurality of stages 242 (shown in FIGS. 5 and 6) during raising operations. The cap end of the cylinder 240 may be pivotally connected with the base 222 via a pivoting connection 244, while the rod or extendable end of the cylinder 240 may terminate with a connector 246, such as a rod eye, operable to pivotally couple with the connectors 232, 234. Two or more manipulating or positioning cylinders 250 may be connected to the raising cylinder 240 and operable to orient, move, or direct the raising cylinder 240 such that the connector 246 is aligned with the corresponding connectors 232, 234 to permit the connectors 246 and 232, 234 to be coupled together and, thus, permit the mast 210 and the substructure 220 to be raised. The cap end of each positioning cylinder 250 may be pivotally connected with the base 222 via a corresponding pivoting connection 252, while the rod or extendable end 254 of each cylinder 250 may be pivotally connected with the raising cylinder 240 via a corresponding pivoting connection 256.

The positioning cylinders 250 may be in communication with and operated by a controller 260. The positioning cylinders 250 may be or comprise the hydraulic cylinders 150, 152 and the controller 260 may be or comprise the controller 190, as described above and shown in FIG. 1. The positioning cylinders 250 may be operated by the controller 260 via the hydraulic control system 106 (not shown in FIGS. 2 and 3) fluidly connected with the positioning cylinders 250. As described above, the controller 260 may be in communication with the valves 130, 170, 186, 188 and the sensors 126 of the hydraulic control system 106 to adjust or otherwise control flow of the hydraulic fluid to control the movement and position of the positioning cylinders 250 to orient or direct the raising cylinder 240 into alignment and/or connection with the connectors 232, 234. The hydraulic fluid may be metered via one or more chambers 102 to precisely control the volume of the hydraulic fluid received by one or both of the hydraulic cylinders 250 to facilitate precise orientation or positioning of each of the raising cylinders 240.

Figure 5:
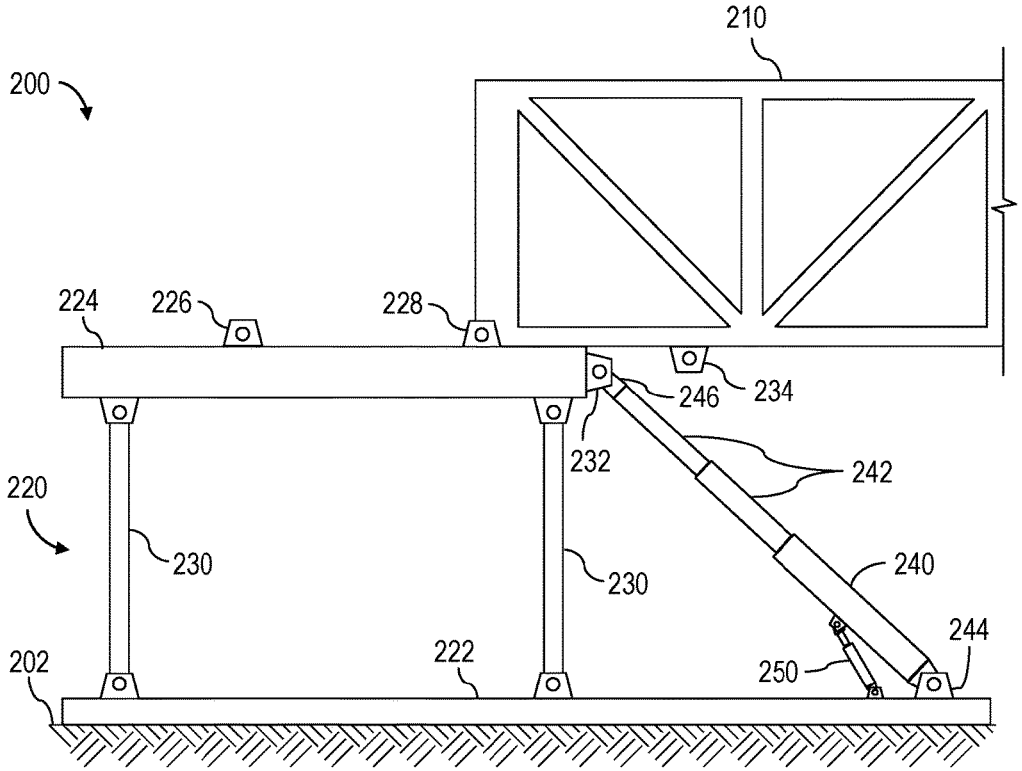
FIG. 5 is another view of the apparatus shown in FIGS. 2 and 4 in a different stage of operation.
Figure 6:
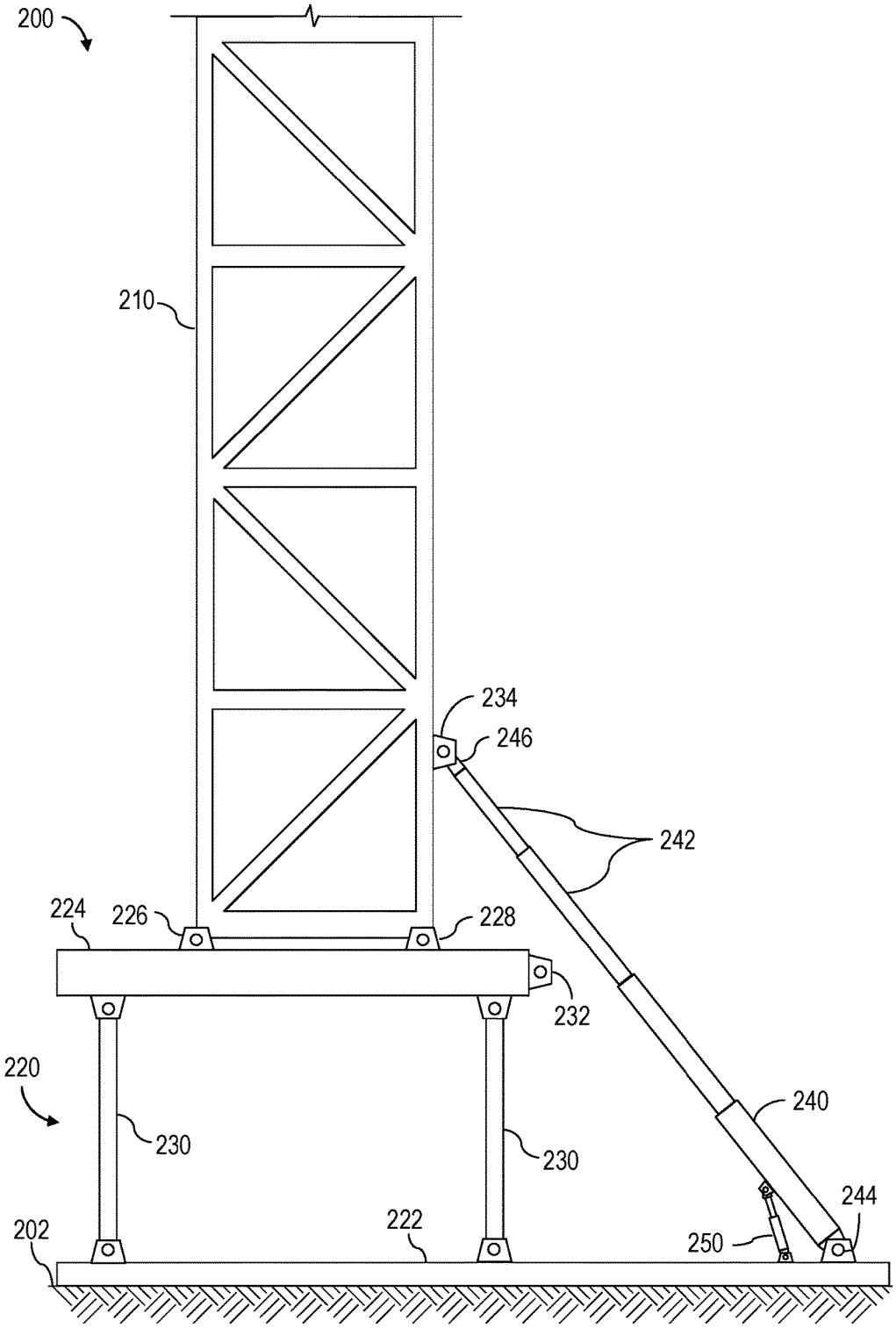
FIG. 6 is another view of the apparatus shown in FIGS. 2, 4, and 5 in a different stage of operation.

FIGS. 4-6 show a portion of the wellsite system 200 shown in FIG. 2 at different stages of raising operations utilizing the raising cylinder 240 to lift the mast 210 and the substructure 220 to their deployed or operating positions. The following description refers to FIGS. 1-6, collectively.

FIG. 4 shows the substructure 220 and the mast 210 disposed at the wellsite surface 202 in the transportable collapsed position and ready to be raised to their deployed position. The drill floor 224 is shown located in the lowered position against the base 222 and the mast is shown in a lowered horizontal position, extending along the drill floor 224 and the base 222.

The substructure 220 may be raised before the mast 210. To raise the substructure 220, a human operator may operate the positioning cylinders 250 and the raising cylinder 240, via the controller 260, to extend the raising cylinder 240 and direct or orient the raising cylinder 240 with the positioning cylinders 250 such that the connector 246 is coupled with the corresponding connector 232 of the drill floor 224 or aligned with the connector 232 to permit the connector 246 to be coupled with the corresponding connector 232, such as via a connection pin. For example, to couple or align the connectors 232, 246, the human operator may cause one of the positioning cylinders 250 to extend by an incremental step or distance associated with a single stroke volume of hydraulic fluid being directed to one of the positioning cylinders 250, as described above, to shift or move the raising cylinder 240 and the connector 246 upwards by a corresponding incremental distance. The human operator may also cause one of the positioning cylinders 250 to extend by the incremental distance and the other positioning cylinder 250 to retract by the incremental distance, as described above, to shift or move the raising cylinder 240 and the connector 246 sideways by a corresponding incremental distance. Such operations may be repeated until the connector 246 is coupled or aligned with the connector 232. Once the connectors 232, 246 are coupled, the raising cylinder 240 may be caused to extend further to raise the drill floor 224 and the mast 210 above the base 222. Once the substructure 220 is in its deployed position, as shown in FIG. 5, the substructure 220 may be locked in the deployed position and the connectors 232, 246 may be uncoupled and the raising cylinder 240 may be utilized to raise the mast 210.

To raise the mast 210, the human operator may again operate the positioning cylinders 250 and the raising cylinder 240, via the controller 260 and similarly to as described above, to extend or retract the raising cylinder 240 and direct or orient the raising cylinder 240 with the positioning cylinders 250, such that the connector 246 is coupled with the corresponding connector 234 of the mast 210 or aligned with the connector 234 to permit the connector 246 to be coupled with the connector 234, such as via a connection pin. Once the connectors 234, 246 are coupled, the raising cylinder 240 may be caused to extend to raise the mast 210 toward its vertical position. Once the mast 210 is in its deployed vertical position, as shown in FIG. 6, the mast 210 may be locked in position and the connectors 234, 246 may be uncoupled and the raising cylinder 240 may retracted and disconnected from the base 222 or positioned in an idle state during drilling operations, such as shown in FIG. 2.

A similar process, but in reversed order, may be utilized to collapse the mast 210 and the substructure 220. For example, the human operator may operate the positioning cylinders 250 and the raising cylinder 240, via the controller 260, to extend the raising cylinder 240 and direct or orient the raising cylinder 240 with the positioning cylinders 250 such that the connector 246 is coupled with the corresponding connector 234 of the mast 210 or aligned with the connector 234 to permit the connector 246 to be coupled with the connector 234. Once the connectors 246, 234 are coupled, as shown in FIG. 6, the mast 210 may be unlocked and the raising cylinder 240 may be retracted to collapse the mast to toward its horizontal position against the drill floor 224. The connectors 234, 246 may be uncoupled and the human operator may operate the positioning cylinders 250 and the raising cylinder 240, via the controller 260, to retract or extend the raising cylinder 240 and direct or orient the raising cylinder 240 with the positioning cylinders 250 such that the connector 246 is coupled with the corresponding connector 232 of the drill floor 224 or aligned with the connector 232 to permit the connector 246 to be coupled with the connector 232, as shown in FIG. 5. Once the connectors 246, 232 are coupled, the substructure 220 may be unlocked and the raising cylinder 240 may be retracted to collapse the drill floor 224 against the base 222, as shown in FIG. 4. Thereafter, the mast 210 may be disassembled and the substructure 220 may be moved to another wellsite via a transport vehicle.

Figure 7:
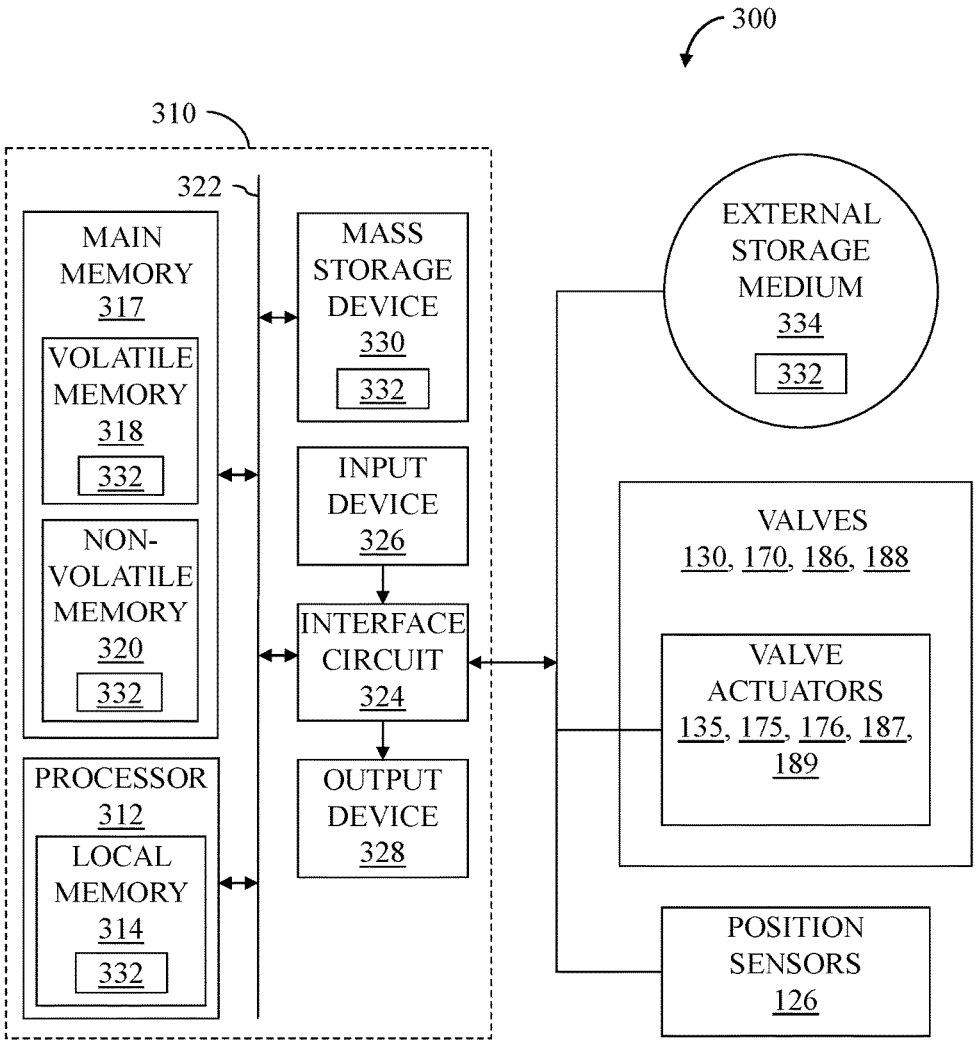
FIG. 7 is a schematic view of at least a portion of an example implementation of apparatus according to one or more aspects of the present disclosure.

Various portions of the apparatus described above and shown in FIGS. 1-6, may collectively form and/or be controlled by a control system, such as may be operable to monitor and/or control at least some operations of the hydraulic system 100 and wellsite system 200, including the hydraulic linear actuators 104, which may be implemented as the hydraulic cylinders 250. FIG. 7 is a schematic view of at least a portion of an example implementation of such a control system 300 according to one or more aspects of the present disclosure. The following description refers to one or more of FIGS. 1-7.

The control system 300 may comprise a controller 310, which may be in communication with various portions of the hydraulic system 100 and wellsite system 200, including the valve actuators 135, 175, 176, 187, 189 to operate the corresponding valves 130, 170, 186, 188 and the position sensors 126 to determine the volume of hydraulic fluid being discharged from the chamber 102. For clarity, these and other components in communication with the controller 310 will be collectively referred to hereinafter as "actuator and sensor equipment." The controller 310 may be operable to receive coded instructions 332 from the human operators and signals generated by the position sensors 126, process the coded instructions 332 and the signals, and communicate control signals to the actuators 135, 175, 176, 187, 189 to implement at least a portion of one or more example methods and/or processes described herein, and/or to implement at least a portion of one or more of the example systems described herein. The controller 310 may be or comprise the controller 190, 260 described above.

The controller 310 may be or comprise, for example, one or more processors, special-purpose computing devices, servers, personal computers (e.g., desktop, laptop, and/or tablet computers) personal digital assistant (PDA) devices, smartphones, internet appliances, and/or other types of computing devices. The controller 310 may comprise a processor 312, such as a general-purpose programmable processor. The processor 312 may comprise a local memory 314, and may execute coded instructions 332 present in the local memory 314 and/or another memory device. The processor 312 may execute, among other things, the machine-readable coded instructions 332 and/or other instructions and/or programs to implement the example methods and/or processes described herein. The programs stored in the local memory 314 may include program instructions or computer program code that, when executed by an associated processor, facilitate the hydraulic system 100 and wellsite system 200 to perform the example methods and/or processes described herein. The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

The processor 312 may be in communication with a main memory 317, such as may include a volatile memory 318 and a non-volatile memory 320, perhaps via a bus 322 and/or other communication means. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The controller 310 may also comprise an interface circuit 324. The interface circuit 324 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 324 may also comprise a graphics driver card. The interface circuit 324 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). One or more of the actuator and sensor equipment may be connected with the controller 310 via the interface circuit 324, such as may facilitate communication between the actuator and sensor equipment and the controller 310.

One or more input devices 326 may also be connected to the interface circuit 324. The input devices 326 may permit the human operators to enter the coded instructions 332, including control commands, operational set-points, and/or other data for use by the processor 312. The operational set-points may include, as non-limiting examples, flow rate of the hydraulic fluid, pressure of the hydraulic fluid, frequency at which the valve 130 is shifted, direction of movement of the hydraulic actuators 104, 250, position, distance, or range of movement of the hydraulic actuators 104, 250, volume of hydraulic fluid to be metered by the chamber 102, number of stroke volumes to be discharged from the chamber 102, such as to control movement or operation of the hydraulic actuators 104, 250, or other hydraulically operated devices of the wellsite system 200. The input devices 326 may be, comprise, or be implemented by a keyboard, a mouse, a touchscreen, a track-pad, a trackball, an isopoint, and/or a voice recognition system, among other examples.

One or more output devices 328 may also be connected to the interface circuit 324. The output devices 328 may be, comprise, or be implemented by display devices (e.g., a liquid crystal display (LCD), a light-emitting diode (LED) display, or cathode ray tube (CRT) display), printers, and/or speakers, among other examples. The controller 310 may also communicate with one or more mass storage devices 330 and/or a removable storage medium 334, such as may be or include floppy disk drives, hard drive disks, compact disk (CD) drives, digital versatile disk (DVD) drives, and/or USB and/or other flash drives, among other examples.

The coded instructions 332 may be stored in the mass storage device 330, the main memory 317, the local memory 314, and/or the removable storage medium 334. Thus, the controller 310 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code (i.e., software or firmware) thereon for execution by the processor 312.

The coded instructions 332 may include program instructions or computer program code that, when executed by the processor 312, may cause the hydraulic system 100 and wellsite system 200, to perform methods, processes, and/or routines described herein. For example, the controller 310 may receive, process, and record the operational set-points and commands entered by the human operator and the signals generated by the position sensors 126. Based on the received operational set-points, commands, and the signals, the controller 310 may send signals or information to the various valve actuators 135, 175, 176, 187, 189 to automatically perform and/or undergo one or more operations or routines described herein or otherwise within the scope of the present disclosure. For example, the controller 310 may be operable to cause the positioning cylinders 250 perform and/or undergo one or more operations or routines described herein.

In view of the entirety of the present disclosure, including the figures and the claims, a person having ordinary skill in the art will readily recognize that the present disclosure introduces an apparatus comprising: a hydraulic actuator; a fluid chamber comprising a piston slidably movable between first and second ends of the fluid chamber and dividing the chamber into first and second chamber portions; and a hydraulic directional control valve operable to direct a fluid from a fluid source into the first chamber portion to cause a volume of fluid to be discharged out of the second chamber portion into the hydraulic actuator to actuate the hydraulic actuator by a distance corresponding to the volume of fluid received by the hydraulic actuator.

The fluid chamber may be or comprise a rodless hydraulic cylinder.

The hydraulic actuator may be or comprise a hydraulic rotary actuator.

The hydraulic actuator may be or comprise a hydraulic cylinder.

The hydraulic actuator may be a first hydraulic actuator, the volume of fluid may be a first volume of fluid, the incremental distance may be a first incremental distance, the apparatus may further comprise a second hydraulic actuator fluidly connected with the first hydraulic actuator, and the first volume of fluid discharged from the fluid chamber into the first hydraulic actuator may further cause the first hydraulic actuator to discharge a second volume of fluid into the second hydraulic actuator to move the second hydraulic actuator by a second incremental distance corresponding to the second volume of fluid received by the second hydraulic actuator. The first and second incremental distances may be substantially equal. The first and second actuators may move in opposing directions.

The apparatus may further comprise: a position sensor disposed in association with the fluid chamber and operable to generate a signal indicative of position of the piston within the fluid chamber; and a controller comprising a processor and a memory storing computer program code. The controller may be operable to receive the signal from the position sensor and control the hydraulic directional control valve based on the received signal to control flow of the fluid into and out of the fluid chamber.

The hydraulic actuator may be a first hydraulic cylinder, and the apparatus may further comprise: a second hydraulic cylinder; and a third hydraulic cylinder connectable with and operable to raise a mast and a substructure of a drill rig utilized in oilfield operations. The first and second hydraulic cylinders may be connectable with and operable to align the third hydraulic cylinder with one of the mast and the substructure to permit connection between the third hydraulic cylinder and the one of the mast and the substructure.

The present disclosure also introduces an apparatus comprising: (A) a hydraulic actuator; (B) a fluid chamber comprising: (i) a piston slidably movable between first and second ends of the fluid chamber; (ii) a first port extending into the fluid chamber on one side of the piston; and (iii) a second port extending into the fluid chamber on an opposing side of the piston, wherein the second port of the fluid chamber is fluidly connected with the hydraulic actuator; and (C) a hydraulic directional control valve comprising: (i) a first port fluidly connected with a fluid source; (ii) a second port fluidly connected with a tank; (iii) a third port fluidly connected with the first port of the fluid chamber; and (iv) a fourth port fluidly connected with the second port of the fluid chamber. The hydraulic directional control valve is operable to direct fluid from the fluid source into the first port of the fluid chamber to cause the piston to move from the first end to the second end and discharge a volume of fluid out of the second port of the fluid chamber into the hydraulic actuator to move the hydraulic actuator by an incremental distance corresponding to the volume of fluid received by the hydraulic actuator.

The fluid chamber may be or comprise a rodless hydraulic cylinder.

The hydraulic actuator may be or comprise a hydraulic rotary actuator.

The hydraulic actuator may be or comprise a hydraulic cylinder.

The discharged volume of fluid may flow from the second port of the fluid chamber into the hydraulic actuator without flowing through the hydraulic directional control valve.

The hydraulic actuator may be a first hydraulic actuator, the hydraulic directional control valve may be a first hydraulic directional control valve, and the apparatus may further comprise: a second hydraulic actuator; and a second hydraulic directional control valve fluidly connected with the fluid chamber and with the first and second hydraulic actuators. The second hydraulic directional control valve may be operable to direct the volume of fluid discharged from fluid chamber into one of the first and second hydraulic actuators to actuate one of the first and second hydraulic actuators by the incremental distance.

The hydraulic actuator may be a first hydraulic actuator, the volume of fluid may be a first volume of fluid, the incremental distance may be a first incremental distance, the apparatus may further comprise a second hydraulic actuator fluidly connected with the first hydraulic actuator, and the first volume of fluid discharged from the fluid chamber into the first hydraulic actuator may further cause the first hydraulic actuator to discharge a second volume of fluid into the second hydraulic actuator to move the second hydraulic actuator by a second incremental distance corresponding to the second volume of fluid received by the second hydraulic actuator. The first and second incremental distances may be substantially equal. The first and second actuators may move in opposing directions.

The apparatus may further comprise: a position sensor disposed in association with the fluid chamber and operable to generate a signal indicative of position of the piston within the fluid chamber; and a controller comprising a processor and a memory storing computer program code. The controller may be operable to: receive the signal from the position sensor; and control the hydraulic directional control valve based on the received signal to cause the piston to move from the first end to the second end and discharge the volume of fluid out of the second port of the fluid chamber into the hydraulic actuator.

The hydraulic actuator may be a first hydraulic cylinder, and the apparatus may further comprises: a second hydraulic cylinder; and a third hydraulic cylinder connectable with and operable to raise a mast and a substructure of a drill rig. The first and second hydraulic cylinders may be connected with and operable to align the third hydraulic cylinder with one of the mast and substructure to permit connection between the third hydraulic cylinder and the one of the mast and substructure.

The present disclosure also introduces a method comprising: (A) directing a fluid from a fluid source into a first portion of a chamber until a piston moves from a first end of the chamber to a second end of the chamber to: (i) introduce a volume of fluid into the first portion of the chamber; and (ii) discharge the fluid from the second portion of the chamber; and (B) directing the fluid from the fluid source into the second portion of the chamber until the piston moves from the second end of the chamber to the first end of the chamber to: (i) introduce the fluid into the second portion of the chamber; and (ii) discharge the volume of fluid out of the first portion of the chamber into a hydraulic actuator to actuate the hydraulic actuator by an incremental distance.

The piston may divide the chamber into the first and second chamber portions.

The volume of fluid may be substantially equal to an internal volume of the first portion of the chamber.

The hydraulic actuator may be or comprise a hydraulic cylinder.

Directing the fluid from the fluid source into the first portion of the chamber may cause the fluid to be discharged from the second portion of the chamber into a fluid storage container.

The hydraulic actuator may be a first hydraulic actuator, and the method may further comprise directing the volume of fluid into the first hydraulic actuator or a second hydraulic actuator with a hydraulic directional control valve to actuate the first or second hydraulic actuator by the incremental distance.

The hydraulic actuator may be a first hydraulic actuator, the incremental distance may be a first incremental distance, the first hydraulic actuator may be fluidly connected with a second hydraulic actuator, and actuating the first hydraulic actuator may cause a fluid to be discharged from the first hydraulic actuator to the second hydraulic actuator to actuate the second hydraulic actuator by a second incremental distance. The first and second incremental distances may be substantially equal. The first and second hydraulic actuators may move in opposing directions.

The chamber may comprise a position sensor in signal communication with a controller comprising a processor and a memory storing computer program code, and the method may further comprise: generating a signal with the position sensor indicative of position of the piston within the chamber; receiving the signal by the controller; and operating with the controller a hydraulic directional control valve based on the signal to direct the fluid from the fluid source into one of the first and second portions of the chamber.

The hydraulic actuator may be a first hydraulic cylinder connected to a second hydraulic cylinder, a third hydraulic cylinder may be connected to the second hydraulic cylinder, and the method may further comprise: alternatingly directing the fluid from the fluid source into one of the first and second portions of the chamber to repeatedly actuate the first and third hydraulic cylinders until the second hydraulic cylinder is aligned with a mast or a substructure of a drill rig utilized in oilfield operations to permit connection between the second hydraulic cylinder and the mast or the substructure; connecting the second hydraulic cylinder with the mast or the substructure; and operating the second hydraulic cylinder to raise the mast or the sub structure.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a hydraulic actuator;

a fluid chamber comprising a piston slidably movable between first and second ends of the fluid chamber and dividing the chamber into first and second chamber portions; and a hydraulic directional control valve operable to direct a fluid from a fluid source into the first chamber portion to cause a volume of fluid to be discharged out of the second chamber portion into the hydraulic actuator to actuate the hydraulic actuator by a distance corresponding to the volume of fluid received by the hydraulic actuator, wherein:

the hydraulic actuator is a first hydraulic actuator;

the volume of fluid is a first volume of fluid;

the incremental distance is a first incremental distance;

the apparatus further comprises a second hydraulic actuator fluidly connected with the first hydraulic actuator; and the first volume of fluid discharged from the fluid chamber into the first hydraulic actuator further causes the first hydraulic actuator to discharge a second volume of fluid into the second hydraulic actuator to move the second hydraulic actuator by a second incremental distance corresponding to the second volume of fluid received by the second hydraulic actuator, wherein the first and second actuators move in opposing directions.

2. An apparatus comprising:

a hydraulic actuator;

a fluid chamber comprising a piston slidably movable between first and second ends of the fluid chamber and dividing the chamber into first and second chamber portions; and a hydraulic directional control valve operable to direct a fluid from a fluid source into the first chamber portion to cause a volume of fluid to be discharged out of the second chamber portion into the hydraulic actuator to actuate the hydraulic actuator by a distance corresponding to the volume of fluid received by the hydraulic actuator, wherein the hydraulic actuator is a first hydraulic cylinder, and wherein the apparatus further comprises:

a second hydraulic cylinder; and a third hydraulic cylinder connectable with and operable to raise a mast and a substructure of a drill rig utilized in oilfield operations, wherein the first and second hydraulic cylinders are connectable with and operable to align the third hydraulic cylinder with one of the mast and the substructure to permit connection between the third hydraulic cylinder and the one of the mast and the substructure.

3. An apparatus comprising:

a hydraulic actuator;

a fluid chamber comprising:

a piston slidably movable between first and second ends of the fluid chamber;

a first port extending into the fluid chamber on one side of the piston; and a second port extending into the fluid chamber on an opposing side of the piston, wherein the second port of the fluid chamber is fluidly connected with the hydraulic actuator; and a hydraulic directional control valve comprising:

a first port fluidly connected with a fluid source;

a second port fluidly connected with a tank;

a third port fluidly connected with the first port of the fluid chamber; and a fourth port fluidly connected with the second port of the fluid chamber;

wherein the hydraulic directional control valve is operable to direct fluid from the fluid source into the first port of the fluid chamber to cause the piston to move from the first end to the second end and discharge a volume of fluid out of the second port of the fluid chamber into the hydraulic actuator to move the hydraulic actuator by an incremental distance corresponding to the volume of fluid received by the hydraulic actuator, wherein:

the hydraulic actuator is a first hydraulic cylinder;

the apparatus further comprises:

a second hydraulic cylinder; and a third hydraulic cylinder connectable with and operable to raise a mast and a substructure of a drill rig; and the first and second hydraulic cylinders are connected with and operable to align the third hydraulic cylinder with one of the mast and substructure to permit connection between the third hydraulic cylinder and the one of the mast and substructure.

4. A method comprising:

directing a fluid from a fluid source into a first portion of a chamber until a piston moves from a first end of the chamber to a second end of the chamber to:

introduce a volume of fluid into the first portion of the chamber; and discharge the fluid from the second portion of the chamber; and directing the fluid from the fluid source into the second portion of the chamber until the piston moves from the second end of the chamber to the first end of the chamber to:

introduce the fluid into the second portion of the chamber; and discharge the volume of fluid out of the first portion of the chamber into a hydraulic actuator to actuate the hydraulic actuator by an incremental distance, wherein the hydraulic actuator is a first hydraulic cylinder connected to a second hydraulic cylinder, wherein a third hydraulic cylinder is connected to the second hydraulic cylinder, and wherein the method further comprises:

alternatingly directing the fluid from the fluid source into one of the first and second portions of the chamber to repeatedly actuate the first and third hydraulic cylinders until the second hydraulic cylinder is aligned with a mast or a substructure of a drill rig utilized in oilfield operations to permit connection between the second hydraulic cylinder and the mast or the substructure;

connecting the second hydraulic cylinder with the mast or the substructure; and operating the second hydraulic cylinder to raise the mast or the substructure.

* * * * *